US008726830B2

(12) United States Patent
Herre et al.

(10) Patent No.: US 8,726,830 B2
(45) Date of Patent: May 20, 2014

(54) ROBOT COMPRISING A CLEANING DEVICE AND ASSOCIATED OPERATING METHOD

(75) Inventors: Frank Herre, Oberriexingen (DE); Rainer Melcher, Oberstenfeld (DE); Manfred Michelfelder, Steinheim (DE); Thomas Hezel, Asperg (DE); Jüergen Haas, Knittlingen (DE); Bernd Leiensetter, Ilsfeld (DE); Alexander Meiβner, Stuttgart (DE); Marcus Frey, Weil der Stadt (DE)

(73) Assignee: Dürr Systems GmbH, Bietigheim-Bissingen (DE)

( * ) Notice: Subject to any disclaimer, the term of this patent is extended or adjusted under 35 U.S.C. 154(b) by 994 days.

(21) Appl. No.: 12/682,205

(22) PCT Filed: Oct. 6, 2008

(86) PCT No.: PCT/EP2008/008423
§ 371 (c)(1),
(2), (4) Date: Sep. 15, 2010

(87) PCT Pub. No.: WO2009/046952
PCT Pub. Date: Apr. 16, 2009

(65) Prior Publication Data

US 2011/0045194 A1 Feb. 24, 2011

(30) Foreign Application Priority Data

Oct. 8, 2007 (DE) ..... 10 2007 048 248

(51) Int. Cl.

| | |
|---|---|
| ***B05C 11/00*** | (2006.01) |
| ***B05C 13/00*** | (2006.01) |
| ***B05C 21/00*** | (2006.01) |
| ***B05D 1/02*** | (2006.01) |
| ***B05B 13/02*** | (2006.01) |

(52) U.S. Cl.
CPC ..... *B05B 13/0292* (2013.01); *B05B 13/0285* (2013.01); *Y10S 901/49* (2013.01)
USPC ..... 118/70; 901/49

(58) Field of Classification Search
None
See application file for complete search history.

(56) References Cited

U.S. PATENT DOCUMENTS

| | | | | |
|---|---|---|---|---|
| 4,498,414 | A | 2/1985 | Kiba et al. | |
| 4,977,911 | A | 12/1990 | Vetter et al. | |
| 5,127,363 | A * | 7/1992 | Nakamura et al. | 118/695 |
| 2002/0035413 | A1 | 3/2002 | Kinoshita et al. | |
| 2002/0043567 | A1 | 4/2002 | Provenaz et al. | |

(Continued)

FOREIGN PATENT DOCUMENTS

| | | | |
|---|---|---|---|
| DE | 3244053 | A1 | 6/1983 |
| DE | 4129778 | A1 | 7/1992 |

(Continued)

OTHER PUBLICATIONS

Spong, Mark W.—Robot Modeling and Control; 4 pages; John Wiley & Sons (2006).

*Primary Examiner* — Dah-Wei D Yuan
*Assistant Examiner* — Jethro Pence
(74) *Attorney, Agent, or Firm* — Bejin VanOphem & Bieneman PLC

(57) ABSTRACT

Exemplary robots and corresponding exemplary operating methods for a painting system are disclosed. In one example, the robot is a handling robot for opening and closing doors or bonnets of motor vehicle bodies. A robot element of a handling robot that is susceptible to dirt retention, e.g., a handling tool, may be arranged away from the spray jet of a paint during the painting operation and is applied to the component that is to be painted. The robot may include a cleaning device for cleaning or for keeping the robot element of the handling robot that is susceptible to dirt retention clean from paint that is applied with spray jet in the painting operation.

17 Claims, 9 Drawing Sheets

(56) References Cited

U.S. PATENT DOCUMENTS

2007/0089762 A1 * 4/2007 Baumann et al. ..... 134/34

FOREIGN PATENT DOCUMENTS

| | | | | |
|---|---|---|---|---|
| DE | 10240073 | A1 | | 12/2003 |
| DE | 60125369 | T2 | | 10/2007 |
| EP | 0333040 | A2 | | 9/1989 |
| EP | 0446120 | A2 | | 9/1991 |
| EP | 446120 | A2 | * | 9/1991 |
| EP | 1327485 | A2 | | 7/2003 |
| GB | 2367119 | A | | 3/2002 |
| JP | 03254860 | A | | 11/1991 |
| JP | 04074556 | A | | 3/1992 |

* cited by examiner

ROBOT COMPRISING A CLEANING DEVICE AND ASSOCIATED OPERATING METHOD

CROSS-REFERENCE TO RELATED APPLICATIONS

This application is a National Phase application claiming the benefit of International Application No PCT/EP2008/0108423 filed Oct. 6, 2008, which claims priority to German Patent Application No. DE 102007048248, filed Oct. 8, 2007, the complete disclosures of which are hereby incorporated in by reference in their entireties.

BACKGROUND

The present disclosure relates to a robot, for example a handling robot for opening and closing doors or bonnets of motor vehicle bodies during a painting process.

In addition, the present disclosure relates to a corresponding operating method for a robot of this type.

In modern painting plants for motor vehicle bodies, the motor vehicle bodies to be painted are generally transported with doors and bonnets installed through the painting plant and painted by a multi-axis painting robot. For the internal painting of the motor vehicle bodies, the doors and bonnets are opened by a multi-axis handling robot and closed again after the internal painting is completed. For this purpose, the handling robots typically comprise handling tools in the form of grippers that are able to grip the doors or bonnets to be opened.

It is problematic in this context that the handling tools (grippers) of the handling robots are exposed to the spray jet of the painting robot and are therefore soiled by the applied paint.

A painting robot itself is also typically soiled by the spray jet applied, because the painting robot cannot be completely prevented from travelling through the spray jet applied by itself or by a neighbouring painting robot.

For one thing, this soiling of the robots by paint can lead to paint dripping from the soiled surfaces of the robots and onto the components to be painted in the worst case, which would lead to damage to the previously applied paint layer. This danger also exists in the case of dried overspray in a powder form, which can reach the motor vehicle body to be painted from the handling robot (e.g. door opener, bonnet opener); this can be caused, for example, by booth air, movements of the robots or vibrations.

For another thing, the paint adhesions on the robot, e.g., on surfaces used to manipulate closure panels such as doors or hoods, should be removed when a colour is changed in order to avoid subsequent soiling by the paint adhesions of a different colour. This is only unnecessary if the handling tools (e.g. grippers) grip surfaces of the motor vehicle body that are not to be painted, as is currently usual.

In the conventional painting plants for motor vehicle bodies, the painting operation is regularly interrupted for this reason, so that the robot soiled with paint can be cleaned manually, e.g., by the maintenance staff.

For one thing, a disadvantage of this manual cleaning method is the fact that the painting operation must be interrupted to clean the robot, thereby reducing the economic viability of the painting plant.

For another thing, dust or dirt enters the painting booth at each cleaning of the robot, because the maintenance staff who have to enter the painting booth to clean the handling robot always bring at least some residual dust in their clothing and on their bodies (e.g. on the parts of the body not covered by protective clothing, such as the face, the neck and the hair). This leads to the fact that painting faults, which have to be touched up expensively, occur increasingly after the automatic robot has been cleaned, in the case of conventional painting plants.

In addition, reference must also be made to DE 601 25 369 T2, GB 2 367 119 A, US 2002/0035413 A1, DE 32 44 053 A1, EP 1 327 485 A2 and DE 41 29 778 A1 concerning the state of the art.

The underlying object of the exemplary illustrations is therefore to create a correspondingly improved robot and to specify an associated operating method.

BRIEF DESCRIPTION OF THE FIGURES

The present disclosure will be further explained using the exemplary illustrations shown in the figures. More specifically, the figures show as follows.

DETAILED DESCRIPTION

Figure 1:
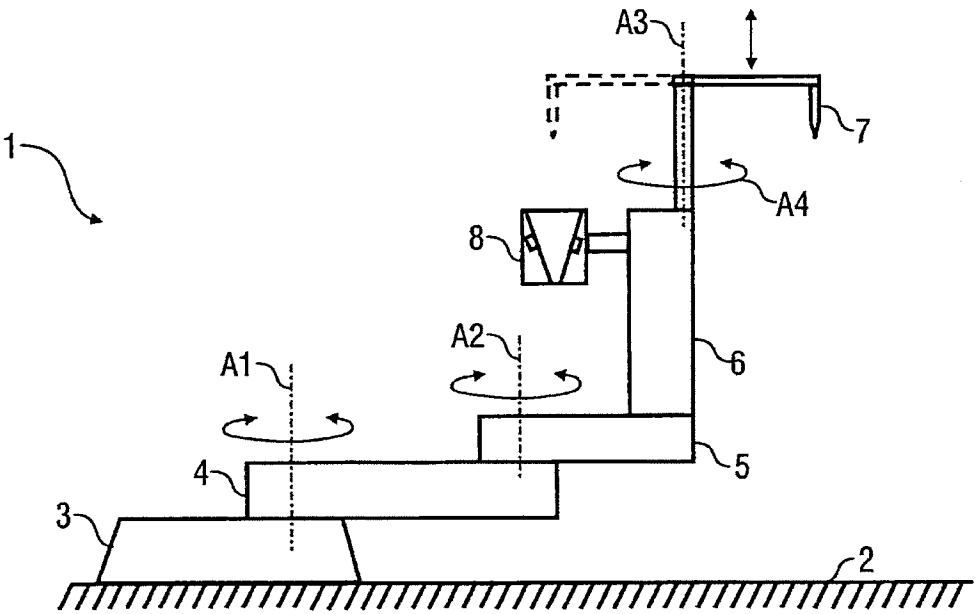
FIG. 1 A schematic side view of a SCARA robot used as a handling robot with a cleaning device according to one exemplary illustration, where an exemplary cleaning device is attached on the outside of the handling robot, FIG. 2 A modification of the handling robot from FIG. 1 according to another exemplary illustration, where the cleaning device is integrated into the housing of the handling robot, FIG. 3 A modification of the handling robot from FIG. 1 according to a further exemplary illustration, where the cleaning device is arranged in a painting booth, separated structurally from the handling robot, FIG. 4 A further exemplary illustration of a handling robot comprising a supply container and disposal container for protective coverings that prevent the soiling of the handling tool and can be replaced independently, FIG. 5 A further exemplary illustration of a handling robot, where the robotic arm guiding the handling tool only offers a minimum contact surface to the spray jet, FIG. 6 An exemplary illustration of a handling robot with a defined drip area, FIG. 7 An exemplary illustration of a handling robot with an absorbent coating of the robotic arm, FIG. 8 An exemplary illustration of a handling robot with cleaning nozzles to prevent a paint deposit, FIG. 9 An exemplary illustration of a handling robot, where the handling tool is cleaned by a rotating spray, and FIG. 10 A simplified representation in cross-section of an exemplary robotic arm of a handling robot with a protective covering to prevent paint adhesions.

The present disclosure comprises the general technical concept to clean the handling tool of a handling robot or another robotic limb susceptible to soiling (e.g. a hand axis or a robotic arm) of the robot generally automatically, e.g., without requiring manual intervention by a user or service personnel.

For one thing, the exemplary illustrations advantageously reduce or eliminate interruptions, to the production of the painting plant for cleaning the robot; the economic viability of an associated painting plant is improved because of this.

For another thing, the automatic cleaning of the exemplary handling robots also offers the advantage that the maintenance staff do not have to enter the painting booth for cleaning purposes, so that little or no dust also enters the booth during the cleaning; the number of painting faults is thereby reduced and the quality of the painting is therefore improved through this.

However, the exemplary illustrations are not limited to painting plants in which there is no interruption to production during cleaning and the painting booth is not entered by maintenance staff. On the contrary, the exemplary illustrations advantageously provide automatic cleaning of the handling or painting robot independently of the implementation of these technical advantages in a painting plant.

Exemplary robots can also be cleaned partly and/or occasionally manually in the context of the exemplary illustrations, for example in the case of removable half-casings.

In one exemplary illustration, a cleaning device that cleans the handling tool or another robot limb susceptible to soiling from the paint that has been deposited during the painting operation is provided.

The cleaning device generally prevents the depositing of paint on the handling tool or on the other robotic limb susceptible to soiling in another example, as further described below.

Both illustrations mentioned above may be provided individually or combined with each other. It is also possible that an exemplary cleaning device generally prevents paint from being deposited on the handling robot and cleans the handling robot from adhering paint.

In one exemplary illustration, the cleaning device comprises an insertion opening into which the handling robot inserts the handling tool to be cleaned, if cleaning is necessary. Cleaning devices of this type for cleaning atomizers, for example, are generally known from EP 0 333 040 A2 and DE 102 40 073 A1 and can also be used for cleaning handling tools in principle, and these publications are hereby expressly incorporated by reference in their entireties. However, the exemplary illustrations are not limited to conventional cleaning devices for atomizers, with regard to the structure and functioning of the cleaning device, but it can also be implemented with other types of cleaning devices in principle.

For example, the handling robot can carry out a linear motion of the handling tool during insertion of the handling tool into the insertion opening. The handling robot can insert the handling tool into the insertion opening of the cleaning device linearly, from up to down, for example. However, it is alternatively possible that the handling robot carries out a combined motion, e.g., consisting of a rotary and a linear motion, to insert the handling tool into the insertion opening of the cleaning device.

Apart from this, the exemplary handling robots may carry out a swivelling motion to insert the handling tool into the insertion opening of the cleaning device. For example, the cleaning device can be aligned generally horizontally, so that the handling tool can be inserted into the insertion opening of the cleaning device horizontally. This motion can be realised by the fact that the handling tool is swivelled around a rotating axis running horizontally.

However, the exemplary illustrations are not limited to the examples specified above with regard to the insertion of the handling tool into the insertion opening of the cleaning device. On the contrary, different kinematics enabling the insertion of the handling tool into the insertion opening of the cleaning device are also conceivable in the context of the exemplary illustrations.

In addition, the cleaning device may be attached, along with the insertion opening for the handling tool, to the outside of the handling robot.

Alternatively, the cleaning device may be arranged with the insertion opening for the handling tool in the casing of the handling robot.

In addition, the possibility that the cleaning device for the handling tool is attached to a booth floor or to a wall of a painting booth as stationary, structurally separated from the handling robot, also exists in the context of the exemplary illustrations.

It has already been mentioned above that cleaning devices for atomizers are generally known. By contrast, an exemplary cleaning device may serves both to clean an atomizer as well as to clean an exemplary handling tool in one illustration. This offers the advantage that a separate cleaning device for the handling tool can be dispensed with, by using the cleaning device available anyway for the atomizer.

In one example, the cleaning device comprises a protective covering, which covers the handling tool or the robotic part susceptible to soiling at least partly and thus prevents a soiling of the handling tool or of the robotic part susceptible to soiling with the applied paint or makes it more difficult at least. It is advantageous here if the protective covering can be replaced, in order to be able to replace a soiled protective covering with a clean protective covering.

For example, a protective covering of this type can be made of a protective cap or protective foil that will prevent a soiling of the handling tool.

The protective covering can be lifted up generally automatically by the handling robot by means of low pressure or a locking mechanism (e.g. catch, stopping lever or similar), for example. Alternatively, the protective covering can be lifted up by means of a Velcro fastening, Velcro tape or a magnet, which can also serve as an attachment means.

The protective covering can then be cast off automatically after soiling; this can be done with low pressure or with a mechanically operated ejection cylinder, for example.

A disposal container may also be provided, where the handling robot can dispose of the soiled protective coverings in the disposal container independently.

In addition, a supply container containing a supply of clean protective coverings may be provided, where the handling robot can take the clean protective coverings from the supply container independently.

The exemplary handling robots may include a compressed air facility, to cast off or aspirate the protective covering, for this reason.

The possibility again exists here that the disposal container or the supply container is attached to the outside of the handling robot.

Alternatively, the possibility exists that the disposal container or the supply container is attached on the booth floor or the wall of the painting booth, structurally separate from the handling robot.

In one example, the protective covering for the handling robot consists of two half-casings that surround the robotic limb susceptible to soiling (e.g. robot manual axis) when installed and are connected to each other by an attachment means, by means of which the protective covering is attached to the robotic limb susceptible to soiling.

For example, the attachment means to connect the two half-casings can be a conventional Velcro tape.

Alternatively, however, the possibility exists that a cable binder or a Velcro fastening is used as an attachment means of connection to connect the two half-casings of the protective covering, where it is particularly easy and therefore advantageous to handle a Velcro fastening.

In addition, the cleaning of the handling tool can be implemented by connecting the handling tool to the rest of the handling robot with a quick change coupling, in order to enable a fast replacement of the soiled handling tool by a clean handling tool. The separated handling tool can then be deposited directly in a cleaning device, so that the cleaning of the previously replaced and deposited handling tool takes place during the painting operation.

In addition, in one exemplary illustration a distal robotic arm serving to guide the handling tool is connected to the rest of the handling robot by a quick change coupling, in order to enable a fast replacement of the soiled robotic arm, with the handling tool attached to it.

In one example, soiling of the handling robot may be minimized by the fact that the distal robotic arm serving to guide the operational tool is aligned at an acute angle or even parallel to the paint spray jet, in order to offer the smallest possible contact surface to the spray jet.

In addition, the possibility exists that the robotic arm serving to guide the handling tool comprises a drip area, at which the paint drips from the robotic arm. For example, the drip area can be formed by a corrugation in the robotic arm. The drip area can be influenced in a targeted way because of this constructive measure; unwanted dripping at disruptive places above the component surfaces to be painted or on the handling robot itself may thereby be prevented.

In addition, the possibility that the robotic arm serving to guide the handling tool and/or the handling tool itself comprise(s) an absorbent coating that absorbs the paint hitting it, thus preventing dripping of the paint or extending the time to the next necessary cleaning exists in the context of the exemplary illustrations.

In addition, the possibility that the robotic arm serving to guide the handling tool and/or the handling tool to be cleaned comprise(s) cleaning nozzles in their/its outer wall(s), through which the cleaning substances (e.g. solvents, compressed air) can be delivered, in order to avoid paint adhesions, also exists in the context of the exemplary illustrations. The robotic arm can also be poriferous, for example, so that the cleaning substance can be discharged over large areas, through the individual pores of the robotic arm. The pores can also be used to allow different quantities of air (hold-off air) that will prevent soiling to be discharged, continuously or at any intervals.

In a further exemplary illustration, the handling robot is arranged in a painting booth with a wall, where the wall restricts the size of the painting booth. A cleaning opening may be arranged in the booth wall in this case, through which the handling tool can be pushed from inside the wall to the outer side of the wall, in order to clean or replace the handling tool outside the painting booth; this can take place automatically or manually.

In addition, the handling robot in the context of the exemplary illustrations may be a Selective Compliants Assembly Robot Arm (SCARA) robot that comprises vertically aligned rotating axes of motion and is also described as a horizontal jointed robot arm, because only rotary motions in a horizontal direction are mainly possible. For example, SCARA robots of this type, e.g., general structure and functioning of SCARA robots, are described in SPONG/HUTCHINSON/VIDYASAGAR: "Robot Modelling and Control", pages 15-16, John Wiley & Sons (2006), which is hereby expressly incorporated by reference in its entirety.

In addition, the exemplary illustrations are not limited to a handling robot (e.g. door opener, bonnet opener). On the contrary, the exemplary illustrations include a painting robot or any other robot that is also susceptible to soiling. The concept of a robot used in the context of the exemplary illustration may generally be geared to a multi-axis robot with 5, 6 or 7 axes, for example, as compared with so-called side and roof machines.

In addition, it must be mentioned that the exemplar illustrations not only include the exemplary handling robots as described above, but also a complete painting plant with the exemplary handling robot(s).

It can already be seen from the above description that the exemplary illustrations include not only a handling robot and/or a painting plant, but also a corresponding operating method where the cleaning of a handling robot or keeping it clean takes place, e.g., automatically.

An exemplary handling robot may also be cleaned by a neighbouring painting robot. The painting robot can apply solvent (purging agent, cleaning substance) or compressed air on the areas of the robot to be cleaned to do this, where an alternating application of solvent and compressed air is also possible, in order to improve the cleaning effect. The application of solvent or compressed air by the neighbouring painting robot can optionally take place here by means of the atomizer available anyway or by means of a separate cleaning nozzle that can be provided on the painting robot.

The cleaning of the handling robot may advantageously take place during a colour change period or other downtime associated with the painting booth, such that the cleaning of the handling robot occurs during downtime already necessary, e.g., when the paint to be applied is changed. This is advantageous because the cleaning of the handling robot does not add an additional interruption to production.

Apart from this, painting plants generally include regular interruptions to production, e.g., during weekends or at a change of shift, for example, where these interruptions to production taking place anyway can then be used advantageously for cleaning the handling robot.

However, the alternative possibility that the painting operation is interrupted for cleaning the handling robot also exists. This offers the possibility that a cleaning of the handling robot can take place, for example, after each component painting or after a certain number of component paintings, through which the painting quality will be improved.

FIG. 1 shows a handling robot 1 that may be installed on a booth floor 2 of a painting booth in a painting plant and has the task of opening and then closing the doors in the case of motor vehicle bodies with preinstalled doors, for internal painting. In one exemplary illustration, the handling robot 1 is a door-opener.

The handling robot 1 may be formed as a SCARA robot (SCARA: Selective Compliants Assembly Robot Arm) and include two robotic arms 4, 5 that are rotatable around the generally vertically running rotating axes A1, A2, apart from a fixed robot base 3, in this exemplary embodiment.

An extension arm 6, which carries a handling tool 7 on its upper side, may be attached at the distal end of the robotic arm 5, where the handling tool 7 can be pushed along an axis of motion A3 in a vertical direction relative to the extension arm 6 and, apart from this, can be rotated around an axis of motion A4 along a vertical rotary axis of motion.

The handling robot 1 therefore comprises four axes of motion A1-A4 in this exemplary illustration.

In addition, a cleaning device 8, which enables the handling tool 7 to be cleaned, may be attached on the extension arm 6. The cleaning tool 7 is inserted into an insertion opening of the cleaning device 8 and then cleaned in the cleaning device 8 to do this. For example, the cleaning device 8 can be structured like a conventional cleaning device for atomizers, as described in EP 0 333 040 B1; other structures of the cleaning device 8 are however also possible.

The exemplary illustrations shown in FIG. 2 substantially corresponds to the above descriptions and the exemplary illustration represented in FIG. 1, so that reference will be made to the above description, where the same reference numerals will be used for corresponding details, to avoid repetition.

Figure 2:
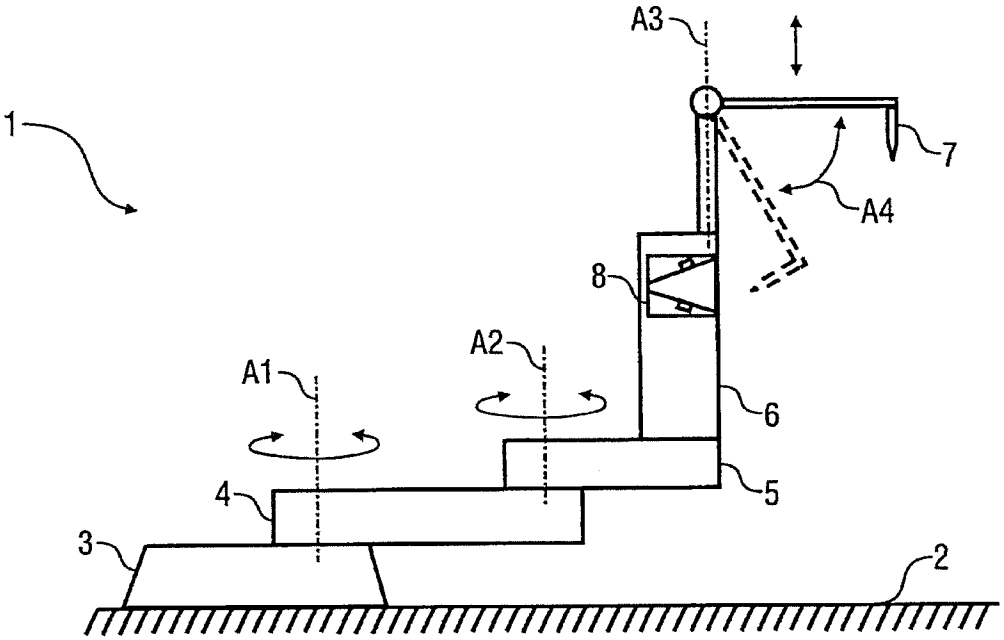

In the exemplary illustration of FIG. 2, the cleaning device 8 is generally arranged in the housing of the extension arm 6.

It is an additional special feature of this example that the cleaning device 8 is aligned horizontally here, so that the handling tool 7 generally must be inserted into the insertion opening of the cleaning device 8 in a horizontal direction.

The axis of motion A4 may thus also be a rotary axis of motion for this reason; however, the rotary axis is aligned at a right angle to the plane of projection here. This means that the handling tool 7 can be swung downwards from the position represented with continuous lines to the position represented with dotted lines and then on to the cleaning device 8 for insertion.

Figure 3:
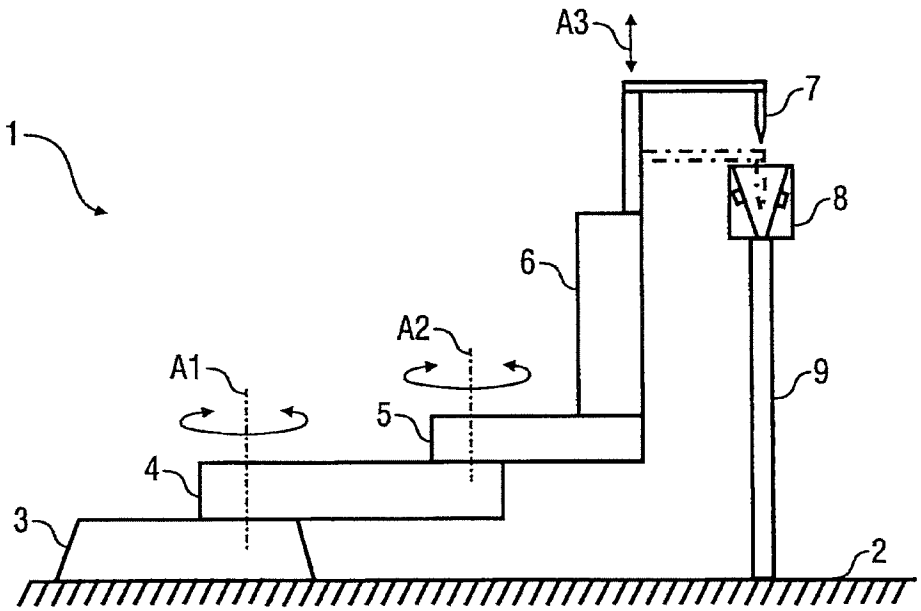

FIG. 3 also shows an example that substantially corresponds to the exemplary illustrations described above and in FIGS. 1 and 2, so that reference will be made to the above description, where the same reference numerals will be used for corresponding details, to avoid repetition.

It is a special feature of this illustration that the cleaning device 8 is installed on a stand 9 on the booth floor 2, separated structurally from the handling robot 1.

Figure 4:
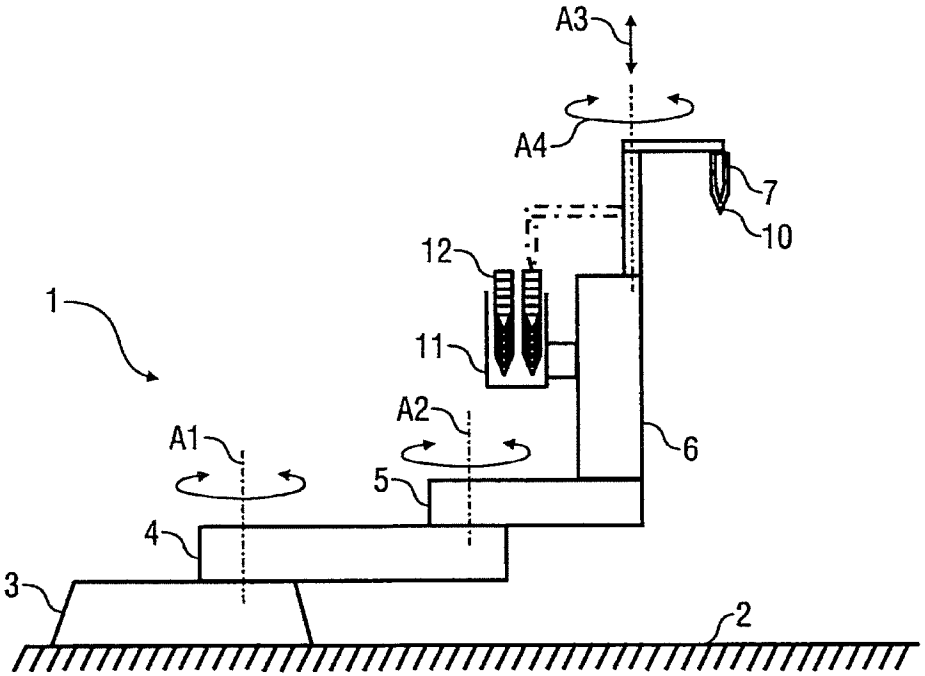

FIG. 4 shows an alternative exemplary illustration of a handling robot 1 that partly corresponds to the exemplary embodiments described above, so that reference will be made to the to the above description, where the same reference numerals will be used for corresponding details, to avoid repetition.

The handling tool 7 is generally covered by a protective covering 10 only represented schematically here, to avoid a soiling of the handling tool 7 during the painting operation.

The soiled protective covering 10 may then be replaced by a clean protective covering for cleaning purposes.

The handling robot 1 comprises a hopper 11 (depot), in which soiled protective covers 10 can be stored and from which new, clean protective coverings 12 can be taken, in this exemplary illustration. The used protective coverings may be cast off from the handling tool 7 by compressed air and the new, clean protective coverings 12 may be taken accordingly from the hopper 11 by negative pressure here.

Figure 5:
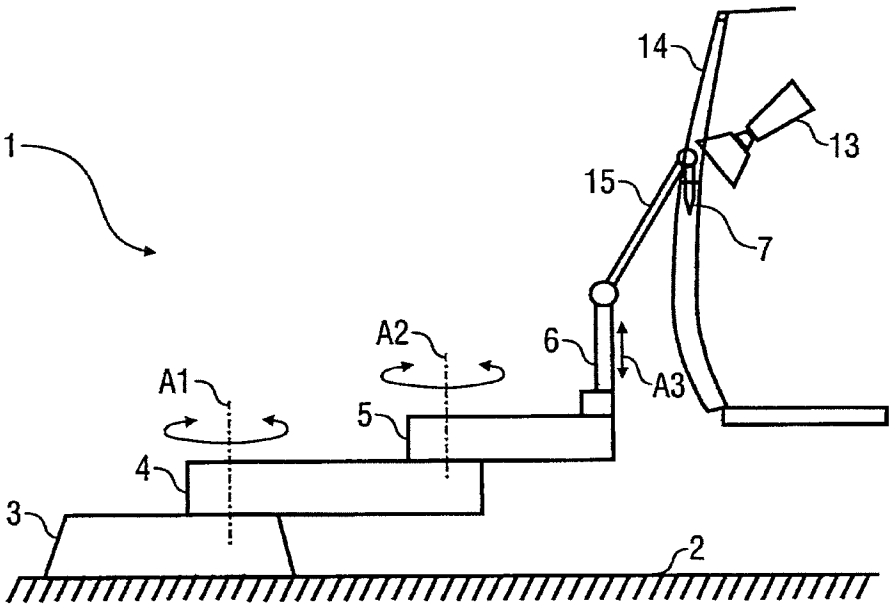

FIG. 5 shows a further exemplary illustration of a handling robot that substantially corresponds to the exemplary illustrations described above, so that reference will be made to the to the above description, where the same reference numerals will be used for corresponding details, to avoid repetition.

A rotary atomizer 13 and a motor vehicle door to be painted 14, into which the handling tool 7 meshes, to open the motor vehicle door to be painted 14, are represented here in addition to the handling robot 1.

It can be seen from this representation that the handling tool 7 is exposed to the spray of the rotary atomizer 13.

However, the handling tool 7 is attached to a distal robotic arm 15 that is aligned at an acute angle to the spray jet of the rotary atomizer 13 here and only forms a small contact surface exposed to the spray jet for this reason; the paint deposits on the robotic arm 15 are minimized by this.

Figure 6:
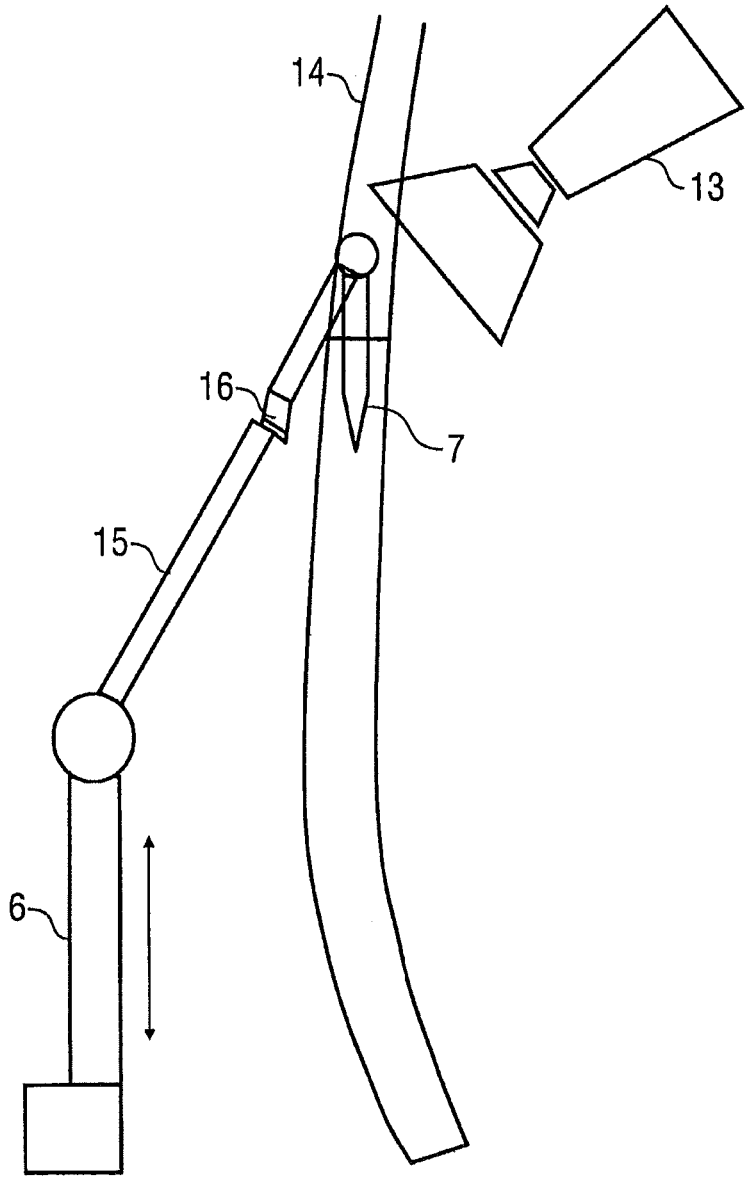

FIG. 6 shows a further exemplary illustration of a handling robot 1 that also substantially corresponds to the exemplary embodiments described above, so that reference will be made to the to the above description, where the same reference numerals will be used for corresponding details, to avoid repetition.

The robotic arm 15 comprises a corrugation 16 forming a drip area here, to clean the handling robot 1 of adhering residual paint, so that the residual paint running down on the robotic arm 15 from above drips down at the corrugation 16 and therefore generally only soils the upper part of the robotic arm 15 above the corrugation 16 considerably.

Figure 7:
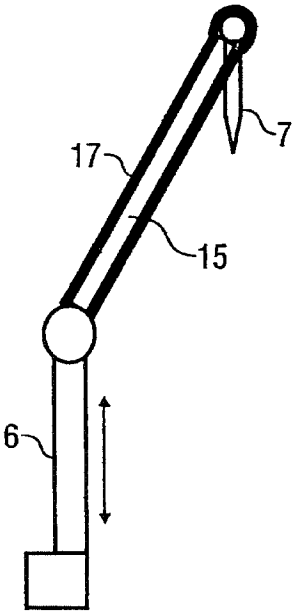

FIG. 7 shows a further exemplary illustration of a handling robot that substantially corresponds to the exemplary illustrations described above again, so that reference will be made to the to the above description, where the same reference numerals will be used for corresponding details, to avoid repetition.

It is a special feature of this exemplary illustration that the robotic arm 15 is coated with an absorbent coating 17 that absorbs the deposited paint and prevents a disruptive dripping of the paint through this.

Figure 8:
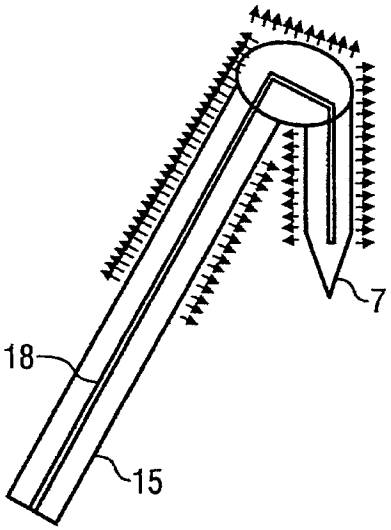

FIG. 8 shows a similar exemplary illustration of the handling robot 1 in turn, so that reference will be made to the above description, where the same reference numerals will be used for corresponding details, to avoid repetition.

The handling tool 7 and the robotic arm 15 comprise a poriferous outer wall here, through which compressed air supplied by a compressed air line 18 can escape. The compressed air escaping from the pores effectively prevents the depositing of paint on the surface of the handling tool 7 and the robotic arm 15 here.

Figure 9:
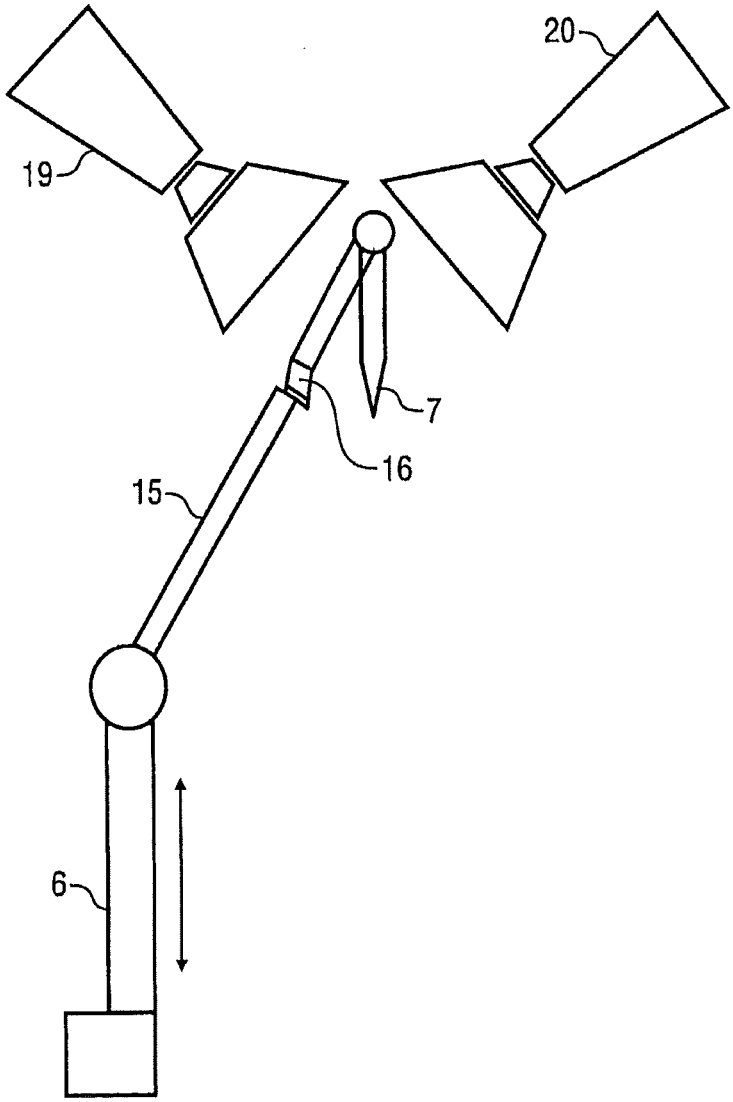

FIG. 9 shows a further exemplary illustration that partly corresponds to the above descriptions and the exemplary embodiment represented in FIG. 6, so that reference will be made to the to the above description, where the same reference numerals will be used for corresponding details, to avoid repetition.

It is a special feature of this exemplary embodiment that the handling tool 7 is cleaned by two rotary atomizers 19, 20, which are available anyway in the painting booth and will be converted for cleaning purposes here. The rotary atomizers 19, 20 apply, for example, compressed air and solvent alternately to the handling tool 7 for this purpose, to remove adhering residual paint.

Figure 10:
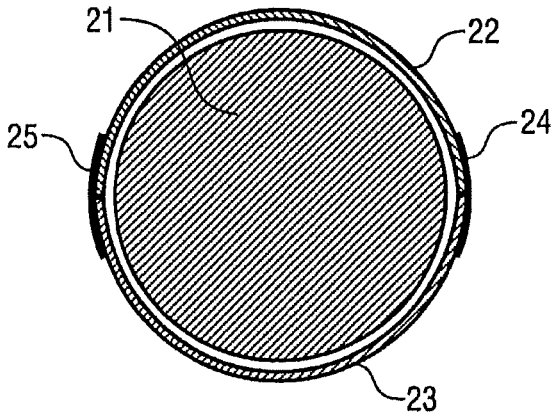

Finally, FIG. 10 shows a simplified representation in cross-section of a robotic hand axis 21 of an exemplary handling robot, where the robotic hand axis 21 is surrounded by two half-casings 22, 23 that are connected to each other by Velcro fastenings 24, 25. The two half-casings 22, 23 effectively prevent paint from being deposited on the robotic hand axis 21 of the handling robot during the painting operation here.

The half-casings 22, 23 can then simply be replaced for cleaning purposes, because the Velcro fastenings 24, 25 enable a generally fast, simple separation.

The exemplary illustrations are not limited to the specific examples described above. Rather, a plurality of variants and modifications are possible, which likewise make use of the concepts of the exemplary illustrations and therefore fall under the scope of protection. Reference in the specification to "one example," "an example," "one embodiment," or "an embodiment" means that a particular feature, structure, or characteristic described in connection with the example is included in at least one example. The phrase "in one example" in various places in the specification does not necessarily refer to the same example each time it appears.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be evident upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary is made herein. In particular, use of the singular articles such as "a," "the," "the," etc. should be read to recite one or more of the indicated elements unless a claim recites an explicit limitation to the contrary.

The invention claimed is:

1. A robot for a painting plant, comprising:

a handling tool configured to handle components to be painted in the painting plant, with the handling tool including a robotic limb susceptible to soiling from a spray jet where at least one of the handling tool and the robotic limb is exposed to the spray jet applied to the component to be painted in the painting operation, and a cleaning device for cleaning paint applied with the spray jet in the painting operation from the at least one of the handling tool and the robotic limb of the robot, the cleaning device located on the robot limb, and defining an enclosure including an insertion opening such that the handling tool is inserted through the insertion opening and into the interior of the cleaning device.

2. Robot in accordance with claim 1, wherein the cleaning device subjects the at least one of the handling tool and the robotic limb to a cleaning treatment, in order to remove adhering paint.

3. Robot according to claim 1, wherein the cleaning device is configured to inhibit the adhesion of paint on at least one of the handling tool and the robotic limb.

4. Robot in accordance with claim 1, wherein the cleaning device defines an insertion configured to receive the handling tool by the handling robot for cleaning, and the handling robot comprises at least one of a linear axis of motion and a rotary axis of motion, to insert the handling tool into the cleaning device for cleaning.

5. Robot in accordance with claim 1, wherein the cleaning device for the handling tool is an atomizer cleaning device configured to clean both an atomizer and the handling tool.

6. Robot in accordance with claim 1, wherein the cleaning device comprises a protective covering that at least partially covers the handling tool or the robotic limb, and wherein the protective covering is configured to be replaced by the robot, in order to replace a soiled protective covering by a clean protective covering.

7. Robot in accordance with claim 6, further comprising a hopper configured for disposal of the used protective coverings soiled with paint, where the robot can dispose of the soiled protective coverings in the hopper independently.

8. Robot in accordance with claim 6, further comprising a supply container with a supply of clean protective coverings, where the robot can take clean protective coverings from the supply container independently.

9. Robot in accordance with claims 7, further comprising a supply container with a supply of clean protective coverings, where the robot can take clean protective coverings from the supply container independently;

wherein the disposal container and the supply container are attached on the outside of the robot.

10. Robot in accordance with claims 7, further comprising a supply container with a supply of clean protective coverings, where the robot can take clean protective coverings from the supply container independently; wherein the disposal container and the supply container are attached on a booth floor or wall of a painting booth, separated from the robot structurally.

11. Robot in accordance with claim 6, wherein the protective covering consists of two half-casings that enclose a periphery of the robotic limb when they are installed and are connected by an attachment means.

12. Robot in accordance with claim 1, further comprising a quick change coupling securing one of the handling tool and the robotic limb to the handling robot, the quick change coupling configured to enable a fast replacement of the one of the handling tool and the robotic limb.

13. Robot in accordance with claim 1, wherein the handling tool is attached at the distal end of a robotic arm of the handling robot, and the robotic arm serving to guide the handling tool is aligned at an acute angle to or parallel to the spray jet of the paint, in order to offer the spray jet the smallest contact surface possible, and the robotic arm serving to guide the handling tool comprises a drip area at which the paint drips from the robotic arm, and the robotic arm serving to guide the handling tool comprises an absorbent coating that absorbs paint hitting it and prevents dripping because of this, and the robotic arm serving to guide the handling tool and/or the handling tool comprises cleaning nozzles in their/its outer wall(s), through which a cleaning substance can be discharged.

14. Robot in accordance with claim 1, wherein the robot is arranged in a painting booth with a wall, where the wall restricts the painting booth spatially, and a cleaning opening, through which the handling tool can be pushed from the inside to the outside of the booth wall, is arranged in the booth wall, in order to clean the handling tool outside the painting booth.

15. Robot in accordance with claim 1, wherein the robot is a Selective Complaints Assembly Robot Arm (SCARAB) robot that comprises a plurality of parallel rotary axes of motion.

16. Robot in accordance with claim 1, wherein the handling tool is selected from a group consisting of a door opener or a bonnet opener.

17. Painting plant with a robot in accordance with claim 1.

* * * * *

UNITED STATES PATENT AND TRADEMARK OFFICE

CERTIFICATE OF CORRECTION

PATENT NO. : 8,726,830 B2
APPLICATION NO. : 12/682205
DATED : May 20, 2014
INVENTOR(S) : Frank Herre et al.

It is certified that error appears in the above-identified patent and that said Letters Patent is hereby corrected as shown below:

On the title page, item (75) Inventors: replace Inventor name "Alexander Meißner" with -- Alexander Meissner --.

In the Claims

Column 10 in claim 15, line 56, replace "(SCARAB)" with -- (SCARA) --.

Signed and Sealed this
Fifth Day of August, 2014

Michelle K. Lee

Michelle K. Lee
*Deputy Director of the United States Patent and Trademark Office*